US007401568B2

(12) United States Patent
Debasto

(10) Patent No.: US 7,401,568 B2
(45) Date of Patent: Jul. 22, 2008

(54) BOAT WITH SKYLIGHT WINDOWS

(75) Inventor: Luiz Debasto, Miami, FL (US)

(73) Assignee: Savannah Yacht Company, LLC, Rincon, GA (US)

( * ) Notice: Subject to any disclaimer, the term of this patent is extended or adjusted under 35 U.S.C. 154(b) by 0 days.

(21) Appl. No.: 11/560,956

(22) Filed: Nov. 17, 2006

(65) Prior Publication Data

US 2007/0193495 A1 Aug. 23, 2007

Related U.S. Application Data

(60) Provisional application No. 60/774,750, filed on Feb. 21, 2006.

(51) Int. Cl.
*B63B 17/02* (2006.01)

(52) U.S. Cl. ..... 114/361

(58) Field of Classification Search ..... 114/361
See application file for complete search history.

(56) References Cited

U.S. PATENT DOCUMENTS 2,947,277 A * 8/1960 Stevens ..... 114/71
4,729,334 A * 3/1988 DeJean, Jr. ..... 114/255
7,055,453 B2 * 6/2006 Miotto et al. ..... 114/361

* cited by examiner

*Primary Examiner*—Jesús D Sotelo
(74) *Attorney, Agent, or Firm*—R. Elliott Halsey

(57) ABSTRACT

A large recreational powerboat has a forward passenger area, a helm, and a rearward passenger area. A top deck covers the forward passenger area and extends upwardly over the helm. The rearward passenger area is exposed. A large skylight window is formed streamlined with the boat and is imposed into the top deck. The window extends upwardly and forward to the helm, thereby having portions functioning as a windshield for the boat. The windshield and the skylight window transmit abundant natural light to an atrium room that is located between the helm and the forward passenger area cabin rooms. Individuals in the atrium room are shielded from the elements but at the same time can view the outside environment and communicate with people outside of the forward passenger area.

2 Claims, 3 Drawing Sheets

BOAT WITH SKYLIGHT WINDOWS

CROSS-REFERENCES TO RELATED APPLICATIONS

This application relies on U.S. Provisional Application Ser. No. 60/774,750, entitled "BOAT WITH SKYLIGHT WINDOWS," which was filed on Feb. 21, 2006, for priority. That application is incorporated herein by reference.

STATEMENT REGARDING FEDERALLY-SPONSORED RESEARCH AND DEVELOPMENT (Not Applicable)

(d) Reference to an appendix"
(Not Applicable)

BACKGROUND OF THE INVENTION

1. Technical Field of the Invention

This invention relates generally to boat layouts. Particularly, the present invention relates to a top deck layout, windshield, and helm area enclosure configuration for watercrafts in general.

2. Description of the Related Art

A typical structure for a leisure watercraft includes a deck layout with a main helm area where controls for the boat are located. Sides of the boat and the top deck cover generally define a forward passenger area, often referred to as a cabin. The cabin may be subdivided further into such spaces as sleeping rooms, kitchens, and washrooms in larger boats.

The cabin underneath the top deck of relatively large recreational watercraft may be divided into several large rooms, including full sized bedrooms, showers, and dining areas. However, such larger boats representative of the prior art do not provide for adequate means for illuminating the forward passenger cabin rooms. This area of the boat is usually so poorly illuminated that boaters descending into this area from the helm cannot see well and often lose their footing on the stairway as a result of the darkness. Additionally, people in the forward passenger area socializing, dining, or resting cannot see the environment outside the boat.

Usual methods for attempting to illuminate the forward passenger area include electric lighting, even during daylight hours, because no natural light can penetrate deep into the larger cabin rooms in the bow. The electric lighting systems used in boats however requires custom light bulbs, which do not provide enough light for larger cabin rooms, and replacement bulbs are difficult to obtain. Thus, the layout configuration for prior art recreational boats, especially relatively larger and more luxurious boats, always includes a dark and unseemly cabin space that is avoided by boaters.

In order to provide greater illumination of the spaces underneath the top deck some prior art boats were designed with structures to facilitate the transmission of natural light into the cabin rooms. For example, many boat designs in the prior art rely on a hatch built into the top deck, that when opened, allows some light to enter a minimal area of the cabin rooms. However, the hatch was also designed primarily as an opening for one average sized person to exit the cabin. Consequently, the open hatch transmits minimal natural light into the cabin. Hatches were also designed to have a small window in order to illuminate the cabin when the hatch was in a closed position. However, the amount of illumination was minimal due to the restriction of the size of the hatch door. The light transmitted through the hatch and the hatch window is limited to the immediate space underneath the hatch opening and does not sufficiently illuminate adjacent areas of the cabin room or other rooms in the cabin.

The cabin on a boat is typically accessible through an entryway from a rear area of the boat. In the prior art, the entryway from the rear area of the boat is typically designed and built as a narrow stairway in order to conserve space. Even larger motorboats built to house several people in the cabin are usually designed with relatively narrow entryways into the cabin.

The stairway is usually covered by at least a portion of the top deck. The top deck cover prohibits natural light from properly illuminating the stairway. The prior art boats use small running lights along the edges of the stairs to define and illuminate the stairway. However, the running lights only provide an outline of the stairs, and fail to illuminate the broad stepping surfaces of individual stairs. Even during daylight hours, the boat deck top cover results in the stairway being very dark, thereby causing a safety hazard.

A typical cabin entryway includes a small gate with a latch or a lock. The prior art lacks a design for windows in the gate or door to the cabin, which would allow for individuals behind the locked cabin door to see outside the door to the cabin.

The main helm area where the controls are located is usually covered with a roof enclosure. The enclosure may be removable and made of a durable weather resistant material, such as canvas. Larger motorboats usually have a top roof comprised of a rigid material, such as fiberglass or hard plastic. Additionally, a boat may have frame that is rigidly fixed in place surrounding the helm. The roof or parts of the roof may be removed depending upon weather conditions. However, removable tops, covers, or sections thereof are cumbersome. Additionally, boats lack storage space for removable covers and roofs.

There is a need in the boat industry to provide greater illumination of passenger areas that are covered, especially in order to render the forward passenger area more usable for recreational purposes. What is needed is a substantially rigid and transparent roof structure that transmits natural light into the cabin rooms and other spaces underneath the roof top deck of a leisure watercraft.

BRIEF SUMMARY OF THE INVENTION

One aspect of the present disclosure relates to an improved structure for a top deck, a windshield, and helm of a boat. Another aspect of the present disclosure relates to an improved structure of a forward passenger area for a boat, by providing a skylight ceiling window imposed in the top deck over a substantial portion of the forward passenger area, in order to transmit an abundant amount of natural light into the forward passenger area. Another aspect of the present disclosure relates to an improved structural lighting configuration for a stairway that leads from the helm to the forward passenger area rooms of the boat, by providing a skylight ceiling window imposed into the top deck over the stairway that facilitates the transmission of natural light into the helm, the atrium room, and onto the stairs.

Figure 1:
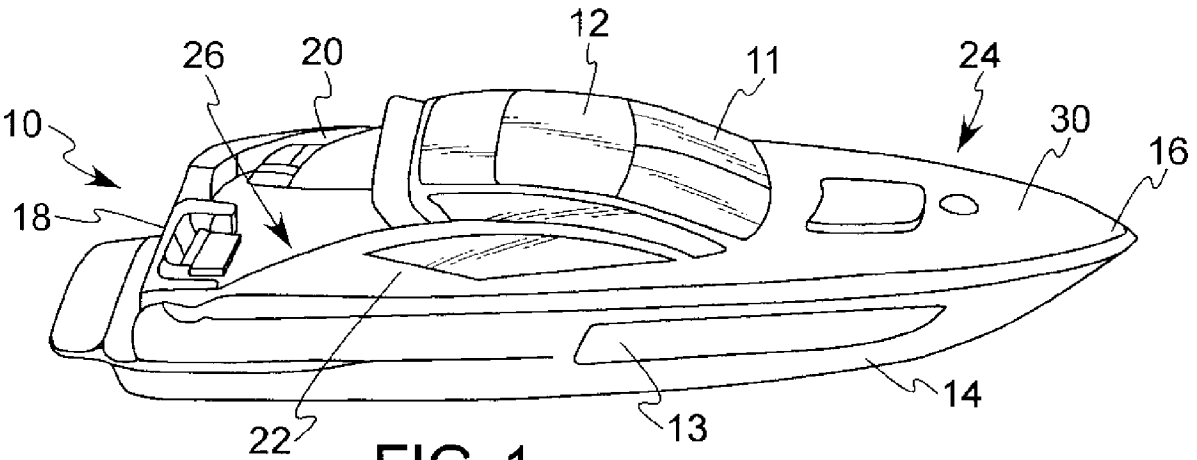
FIG. 1 is a side view in perspective of the preferred embodiment for the boat.

In describing the preferred embodiment of the invention that is illustrated in the drawings, specific terminology will be resorted to for the sake of clarity. However, it is not intended that the invention be limited to the specific term so selected and it is to be understood that each specific term includes all technical equivalents that operate in a similar manner to accomplish a similar purpose.

DETAILED DESCRIPTION OF THE INVENTION

Figure 2:
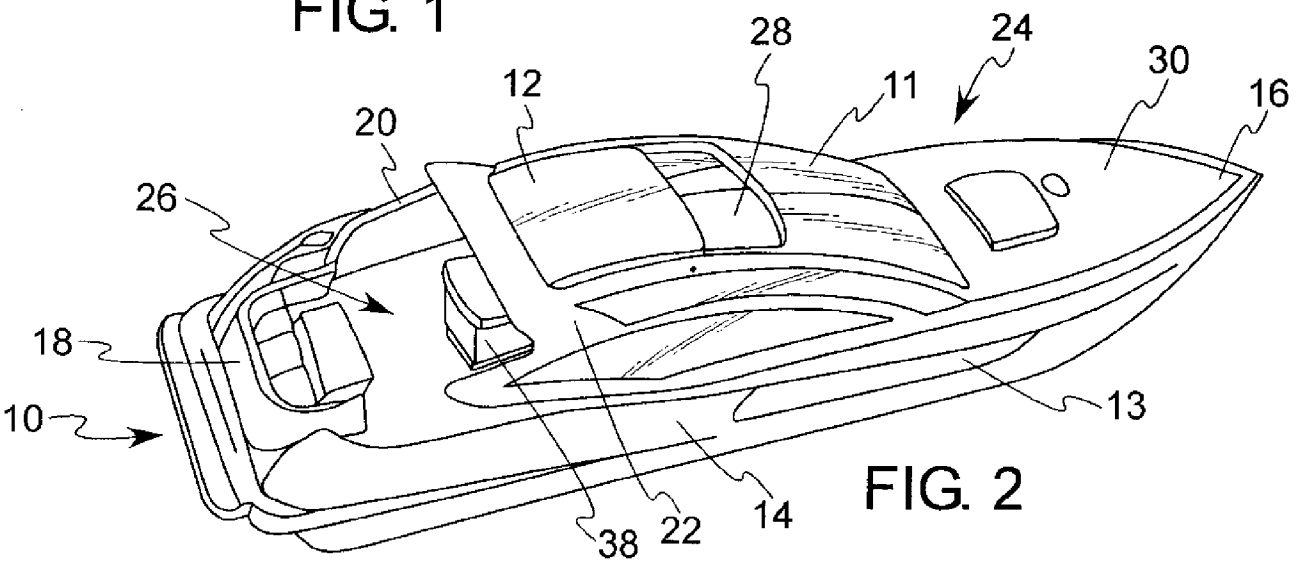
FIG. 2 is a side view in perspective of the preferred embodiment for the boat, and the skylight window is retracted.

FIGS. 1 and 2 illustrate a boat 10 with a skylight window 12. The skylight window 12 retracts from its position in a windshield 11 for the boat 10. The boat 10 has a hull 14, a bow 16, and a stern 18. First and second sides, 20 and 22, respectively, extend between the bow 16 and the stern 18.

Looking at FIG. 2, the layout of the boat 10 includes a forward passenger area 24, a rearward passenger area 26, and a helm 28. In FIG. 2 the skylight window 12 is retracted from the windshield 11, and the helm 28 is visible. The helm 28 is the location where a boat operator controls the speed and direction of the boat 10. The forward passenger area 24 is defined as the section of the boat 10 located forward to the helm 28, and the rearward passenger area 26 is the section of the boat 10 located rearward to the helm 28. A top deck 30 extending between the first side 20 and the second side 22 covers the forward passenger area 24.

Figure 3:
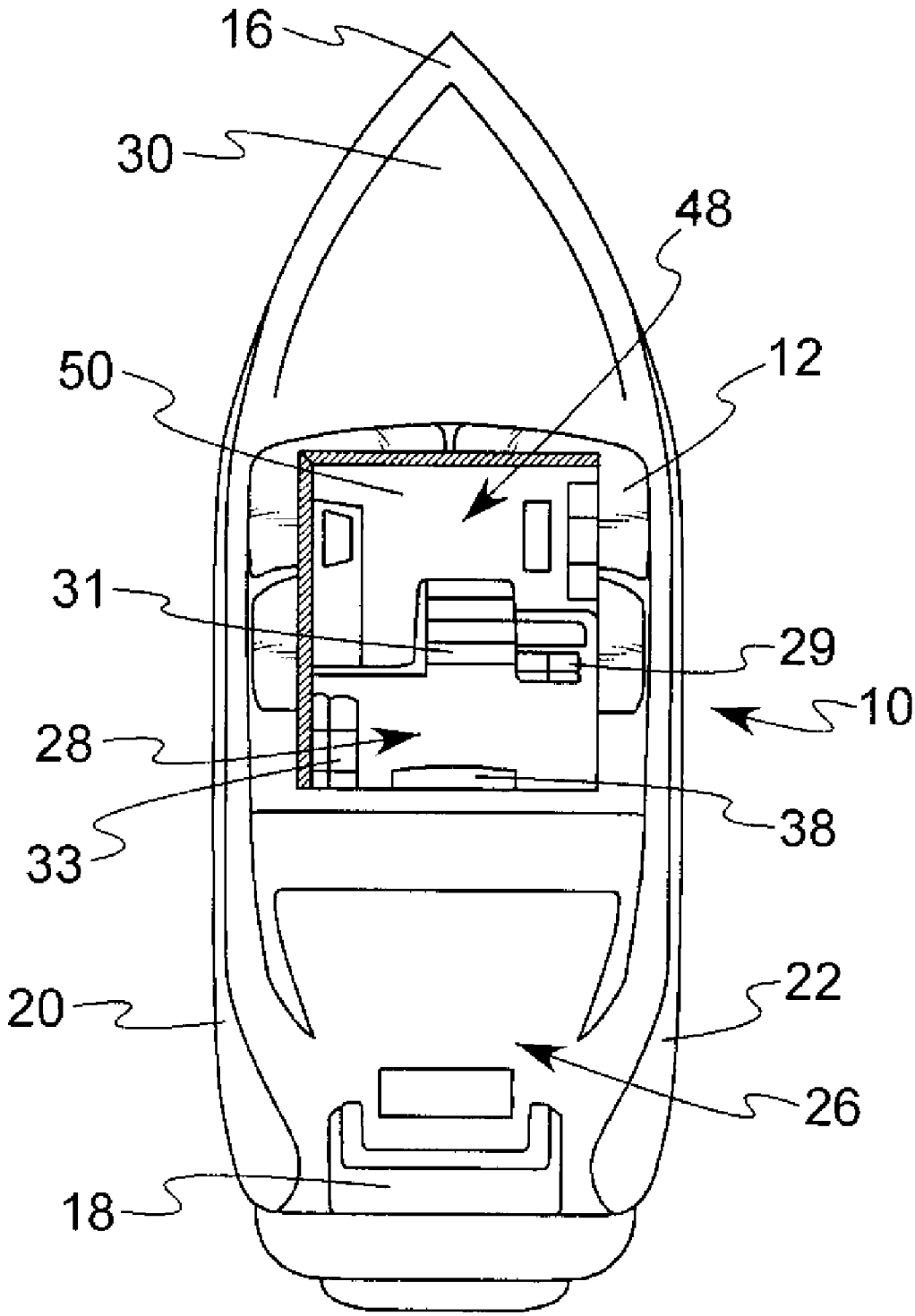
FIG. 3 is a top view of the present invention with a section of the skylight window cut away for viewing into the helm and atrium room.

FIG. 3 is a top view of the boat 10, with a large area of the skylight window 12 depicted as cut away for viewing the helm 28. There is at least one seat 29 in the helm 28 on which the boat operator may sit. The helm 28 is a spacious area, having sufficient space for multiple individual seats or a couch 33. As illustrated in FIG. 3, a stairway 31 leads downward into the atrium room 48.

Figure 4:
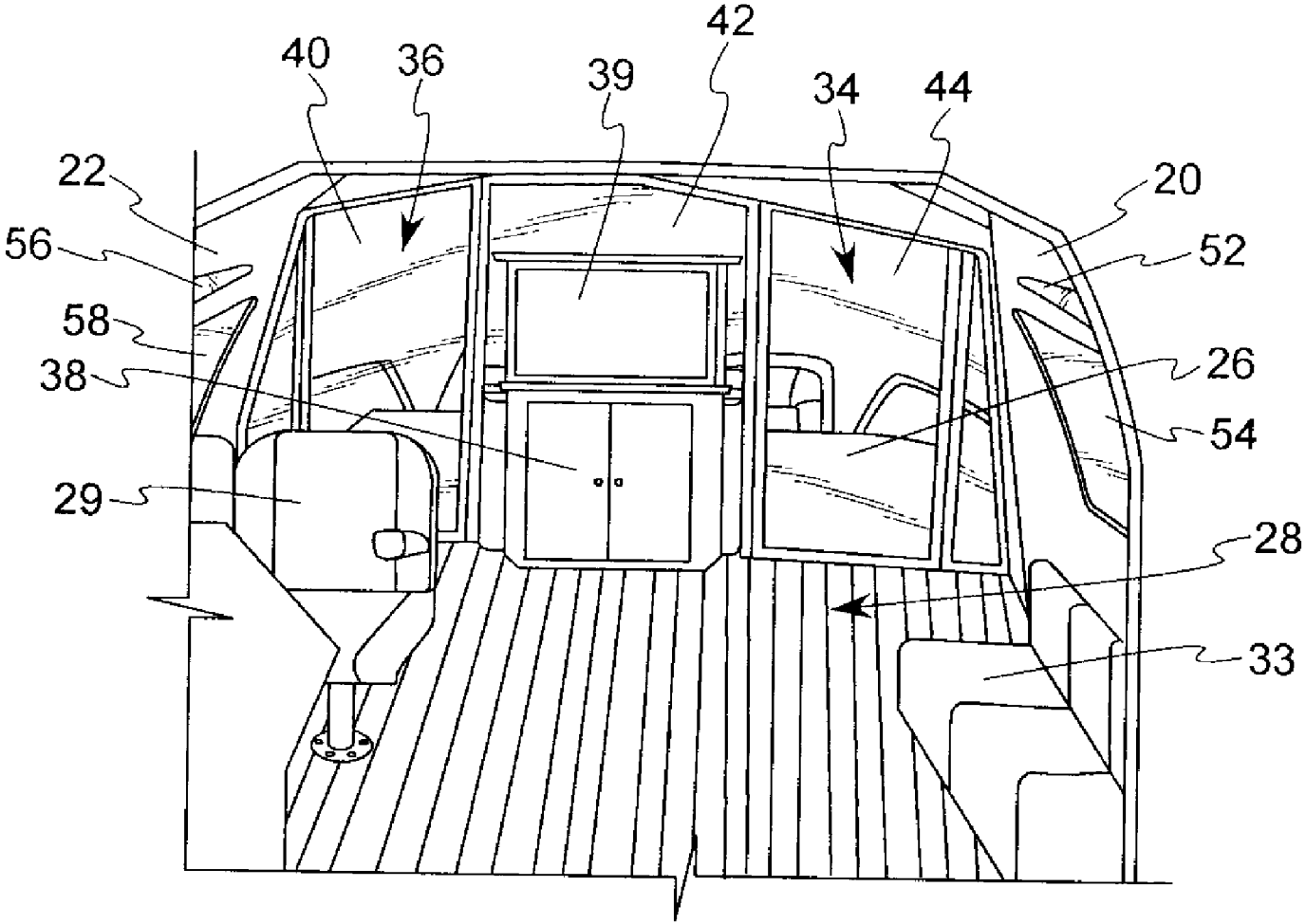
FIG. 4 is a view of the boat from inside the helm looking toward the rearward passenger area.

Looking at FIG. 4, the boat 10 has a first entryway 34 and a second entryway 36 along opposite ends of a center console 38. The entryways 34 and 36 lead between the rearward passenger area 26 and the helm 28. In the preferred embodiment, the center console 38 is large enough to be further customized with features such as a wet bar, a table surface, and an entertainment center 39 with audio and video capabilities.

The helm 28 is separated from the rearward passenger area 26 by a multiplicity of movable panels 40, 42, and 44. The panels 40, 42, and 44 are positioned in the path of the entryway to the helm 28 and laterally collapse by folding to one or both of the sides of the boat 10. The movable panels 40, 42, and 44 lock together for securing the entryways 34 and 36 into the helm 28. The panels 40, 42, and 44 are made of substantially shatterproof glass or a similar material used for transparent doors and windows, such as a rigid plastic. An essential function of the transparent panels 40, 42 and 44 is to permit people inside the helm 28 to have clear visibility of the environment outside of the boat, such as the dock space.

The forward passenger area 24 is maximized in terms of its usable space by having multiple spacious rooms. Generally, a smaller boat 10 has one cabin room defining the region of a boat layout with an area like the forward passenger area 24. The boat 10 is a large recreational watercraft, having the forward passenger area 24 subdivided into rooms such as a kitchen, bedrooms, and a lavatory.

As illustrated in FIG. 3, the present invention includes an atrium room 48 in the forward passenger area 24. The atrium room 48 is made structurally possible by the imposition of a skylight window 12 imposed into the windshield 11 and extends forward into the top deck 30 over the forward passenger area 24. Specifically, at least a substantial portion of the skylight window 12 and the windshield 11 is imposed into the top deck 30 in a position structurally corresponding to a floor 50 of the atrium room 48. The skylight window 12 in the windshield 11 transmits natural light during the daylight hours to the surface area of the walls and the atrium room 48, and the floor 50, as well as a substantial portion of the forward passenger area 24, in order to fully illuminate the atrium room 48 and the forward passenger area 24.

The windshield 11, the skylight window 12, and the top deck 30 are contiguous. The windshield 11 extends upwardly from the top deck 30, from a position forward to the helm 28 and rearward to a position over a substantial portion of the helm 28. The position in the top deck 30 that is forward to the helm 28 to which the contiguous windshield 11, skylight window 12 extend is at least far enough to be over the stairway 31 and the atrium room 48. The windshield 11 may extend forward past the atrium room to a position over additional rooms in the forward passenger area 24.

The windshield 11 and the skylight window 12 are streamlined, meaning they have a form that is contour constructed so as to offer minimum resistance to the flow of air and water. The skylight window 12 functions in conjunction with the windshield 11 to protect the boat operator in the helm 28 from the wind that would otherwise blow through the helm 28. Furthermore, another important aspect of the skylight window 12 is to provide a maximum visibility of the boat operator's field of view. The large area of the skylight window 12 permits ease in viewing the entire horizon and sky, thereby enhancing the ability of the boat 10 to be navigated during inclement weather conditions.

An important feature of the preferred embodiment for the present invention is that the skylight window 12 and windshield 11 enable visibility from the atrium room 48 to the immediate environment outside of the boat 10. The windshield 11 extends over the helm 28 and into a portion of the top deck 30 over the stairway 31 and the atrium room 48. This structural configuration facilitates the transmission of natural light into the atrium room 48, the stairway 31, and the helm 28.

The windshield 11 and the skylight window 12 facilitate the illumination of rooms in the forward passenger area 24. The large area of the skylight window 12 transmits an abundant amount of light into the helm 28, and much of that light is further transmitted into the forward passenger area 24 through doorways.

Another aspect of the present disclosure relates to a structural configuration for an entryway to the forward passenger area 24 of a boat. Larger boats, such as the boat 10, typically include an entryway, such as a stairway, between the forward passenger area 24 and the helm 28. The skylight window 12 transmits natural light to the stairway 31 inside the boat 10 so that an individual utilizing the stairs can clearly view the individual stairs. Additionally, a source of artificial lighting, such as electric lights, may be imposed adjacent to the stairs for illuminating the stairway 31 during nighttime. However, during the daytime natural light transmitted through the windshield 11 and the skylight window 12 sufficiently illuminates the stairway 31.

As illustrated in FIG. 4, lateral skylight windows 52, 54, 56, and 58 are imposed in each of the sides of the boat 10. Preferably, the lateral skylight windows 52, 54, 56, and 58 are positioned in upper areas of each of the first and second sides 20 and 22. The lateral skylight windows 52, 54, 56, and 58 extend longitudinally along each of the first and second sides, 20 and 22, substantially the entire length of the helm 28. The length of each of the windows 52, 54, 56, and 58 is substantially longer than the width. The lateral skylight windows 52,

54, 56, and 58 are configured to transmit natural light into all of the cabin rooms in the forward passenger area 24.

While the boat 10 in the figures is depicted with a specific configuration, those skilled in the art will appreciate that one or more aspects of the present invention may be incorporated into a watercraft, regardless of the particular configuration and layout. Certain preferred embodiments of the present invention have been disclosed in detail, and it is to be understood that various modifications may be adopted without departing from the spirit of the invention or scope of the following claims. For example, the preferred embodiment is a relatively large recreational boat. The skylight window 12 may be imposed in areas of top deck of smaller boats, although the invention is best practiced in hard top boats, because the skylight window 12 is preferably composed of a rigid plastic material. However, a similarly rigid and substantially transparent material such as a tempered glass could also be used.

The invention claimed is:

1. A boat comprising:

a hull having a bow, a stern, and first and second sides extending between said bow and said stern:

a top deck that extends along at least a portion of said first and second sides thereby defining a cabin enclosed underneath said top deck;

a helm having a substantially entirely transparent roof enclosure, said roof enclosure having at least one skylight window and a windshield;

an atrium room formed between said cabin and said helm;

wherein said transparent roof enclosure is contiguous with said skylight window and said windshield, and said windshield extends forward from said helm to a region said top deck above said atrium room and above said cabin for illuminating said atrium and said cabin.

2. A boat comprising:

a hull having a bow, a stern, and first and second sides extending between said bow and said stern, a top deck that extends along at least a portion of said first and second sides thereby defining a cabin enclosed underneath said top deck;

a helm having a roof enclosure;

an atrium room formed between said cabin and said helm;

wherein said roof enclosure has at least one skylight window and a windshield extending forward from said helm above said atrium room to a region of said top deck to a position over said cabin for illuminating said atrium and said cabin, and said roof enclosure over said helm is substantially entirely transparent and contiguous with said skylight window and said windshield, and said windshield extends forward to a region of said top deck above said atrium room and said cabin.

* * * * *